US007460804B2

(12) United States Patent
Onose et al.

(10) Patent No.: US 7,460,804 B2
(45) Date of Patent: Dec. 2, 2008

(54) IMAGE FORMING DEVICE HAVING AN IMAGE DETECTOR

(75) Inventors: Atsushi Onose, Ibaraki (JP); Tatsunari Sato, Ibaraki (JP); Shintaro Yamada, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 122 days.

(21) Appl. No.: 11/017,702

(22) Filed: Dec. 22, 2004

(65) Prior Publication Data

US 2005/0163518 A1 Jul. 28, 2005

(30) Foreign Application Priority Data

Dec. 24, 2003 (JP) ..... P2003-427582
Nov. 5, 2004 (JP) ..... P2004-321851

(51) Int. Cl.
*G03G 15/00* (2006.01)

(52) U.S. Cl. ..... 399/49; 399/98; 399/313

(58) Field of Classification Search ..... 399/49, 399/98, 99, 121, 302, 308, 313
See application file for complete search history.

(56) References Cited

U.S. PATENT DOCUMENTS 4,684,243 A * 8/1987 Minor
7,036,737 B2 * 5/2006 Nakayama et al. ..... 399/49
2002/0098004 A1 * 7/2002 Hama et al. ..... 399/49
2003/0058251 A1 * 3/2003 Nakayama et al.
2003/0091368 A1 * 5/2003 Yamamoto et al.
2004/0100547 A1 * 5/2004 Hattori
2004/0218947 A1 * 11/2004 Oohara et al. ..... 399/302
2004/0264988 A1 * 12/2004 Konishi ..... 399/49
2005/0063718 A1 * 3/2005 Oki ..... 399/49
2005/0095027 A1 * 5/2005 Hatakeyama et al. ..... 399/98

FOREIGN PATENT DOCUMENTS

JP 61073174 A * 4/1986
JP 62127851 A * 6/1987
JP 01167856 A * 7/1989
JP 07-219302 8/1995

* cited by examiner

*Primary Examiner*—David M. Gray
*Assistant Examiner*—Laura K Roth
(74) *Attorney, Agent, or Firm*—McGinn IP Law Group, PLLC

(57) ABSTRACT

An image forming apparatus includes detecting means for detecting a toner image formed on an image carrier, and transport means for transporting a sheet. The detecting means is disposed on an inner side in a width of the image carrier, and on an outer side of a contact region with the transport means and the sheet, in a direction perpendicular to a transporting direction of the sheet.

20 Claims, 3 Drawing Sheets

IMAGE FORMING DEVICE HAVING AN IMAGE DETECTOR

BACKGROUND OF THE INVENTION

1. Field of the Invention

The present invention relates to an image forming apparatus, more specifically relates to an improvement in an image forming apparatus including detect means for detecting a toner image formed on an image carrier (photosensitive member, intermediate transcribing member or the like).

2. Description of the Related Art

There is an image forming apparatus which is known as a printer, a copier or the like for detecting a toner image formed on an image carrier by detect means and making an image forming condition adjustable based on an output of the detect means. For example, JP-A-7-219302 describes a constitution in which a test pattern image is formed on an intermediate transcribing drum, a toner adhering amount is measured from the test pattern image by adhering amount measuring means, and various recoding processes are controlled based on a value of the measurement.

The image carrier is brought into contact with sheet when the toner image is transcribed onto sheet. There is a case in which a foreign substance of paper powder, dust and dirt or the like on sheet adheres to the image carrier by the contact. Almost all of the foreign substance adhered to the image carrier is removed by a cleaner for cleaning the image carrier, there is also a foreign substance adhered to a detecting face of detect means by passing through the cleaner, and when the foreign substance is adhered to the detecting face, the adherence causes to make the output of the detect means unstabilized or bring about erroneous detection.

SUMMARY OF THE INVENTION

It is an object of the invention to provide an image forming apparatus includes a detect means for detecting a toner image formed on an image carrier and transport means for transporting a sheet. The detect means is disposed in correspondence with a position that an inner side of a width of the image carrier, and an outer side of a contact region with the transport means and the sheet in a direction perpendicular to a transporting direction of the sheet.

According to one aspect of the invention, there can be provided an image forming apparatus reducing adherence of a foreign substance to the detect means and having a stable image quality.

DESCRIPTION OF THE PREFERRED EMBODIMENTS

An explanation will be given of embodiments of the invention in reference to the drawings as follows.

Figure 2:
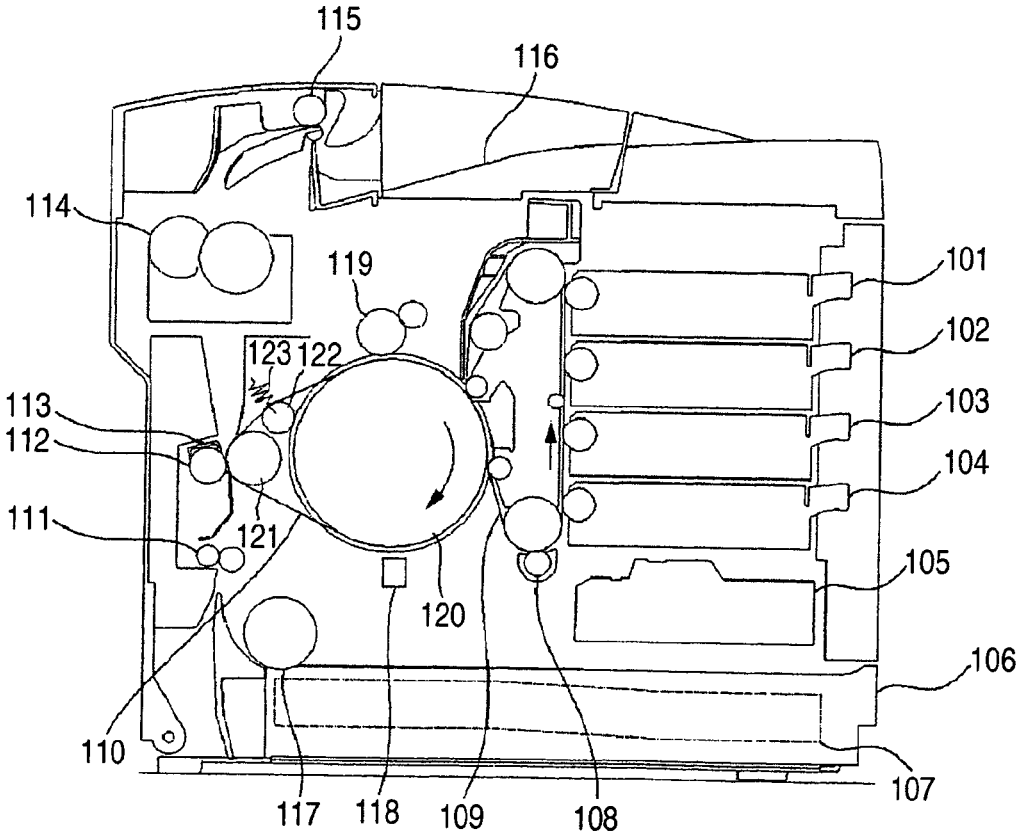
FIG. 2 is a total configuration view of an image forming apparatus to which the invention is applied.

First, an explanation will be given of a total configuration of an image forming apparatus in reference to FIG. 2. In FIG. 2, numeral 109 designates a photosensitive belt supported to be able to move endlessly in an arrow direction. Numeral 108 designates a charger and the charger 108 uniformly charges a surface of the photosensitive belt 109 by a printing start signal from a host. An optical unit 105 for irradiating light to the charged photosensitive belt 109 exposes the photosensitive belt 109 in accordance with printing data from the host to form an electrostatic latent image on the surface of the photosensitive belt 109.

The electrostatic latent image formed on the photosensitive belt 109 is supplied with a toner of any color of developing unit 101, 102, 103, 104 to be visualized as a toner image, and is carried to a region at which the photosensitive belt 109 and an intermediate transcribing member 110 are brought into contact with each other (hereinafter, referred to as "primary transcribing position"). At the primary transcribing position, the toner image on the photosensitive belt 109 is transcribed onto a surface of the intermediate transcribing member 110 by a potential difference between the photosensitive belt 109 and the intermediate transcribing member 110.

The surface of the photosensitive belt 109 which has passed the primary transcribing position is cleaned by a discharger (not illustrated) and a cleaning unit (not illustrated) to be brought into a state of being capable of forming a successive image.

By repeating the above-described step by the respective developing unit 101, 102, 103, 104 in accordance with single color printing and plural colors printing by a necessary number of times, the toner image is formed on the intermediate transcribing member 110.

The toner image transcribed onto the intermediate transcribing member 110 is transcribed onto sheet at a region at which the intermediate transcribing member 110 and a transcribing roller 112 are brought into contact with each other (hereinafter, referred to as "secondary transcribing position"). Sheet transcribed with the toner image is separated from the intermediate transcribing member 110 by being operated by a discharger 113 and is fed to a fixing unit 114. The fixing unit 114 can be applied with a well-known fixing system of a type of nipping and carrying sheet by a heat roller and a press roller (or a heat roller), or a type of nipping and carrying sheet by a heat roller and a press belt (or press belt including a heat source) or the like, and sheet fixed with the toner image is discharged to a sheet discharging tray 116 provided at an upper portion of a main body of the image forming apparatus.

A pair of carrying rollers 111 are provided between a sheet feeding roller 117 and the transcribing roller 112. Although the carrying roller 111 may be a carrying roller for only carrying a sheet 107 fed from a sheet feeding cassette 106 to the secondary transcribing position, according to the embodiment, the carrying roller 111 is provided as a registration roller for correcting a skew of sheet.

The registration roller 111 corrects an attitude of sheet fed from the sheet feeding cassette 106 by the sheet feeding roller 117 and brings sheet at standby and feeds sheet toward the transcribing roller 112 at a timing of transcribing the toner image formed at the intermediate transcribing member 110 to a predetermined position of sheet. Further, a pair of sheet discharging rollers 115 are provided between the fixing unit 114 and the sheet discharging tray 116.

In FIG. 2, numeral 118 designates detecting device which is disposed opposite to the intermediate transcribing member 110 in a path reaching the secondary transcribing position from the primary transcribing position. According to the embodiment, the detecting device 118 is provided with a toner adhering amount sensor for detecting an amount of adhering a toner from the toner image formed on the intermediate transcribing member 110.

By arranging the sensor 118 at a lower side of the intermediate transcribing member 110 as in the embodiment, the sensor 118 can be arranged to be distant from a cleaner 119 of the intermediate transcribing member 110 and the sensor 118 is prevented from contamination by a foreign substance. Further, the sensor 118 can also be made to be distant from the fixing unit 114 and therefore, erroneous detection of the sensor 118 by high temperature can also be reduced.

It is preferable to arrange the sensor 118 perpendicular to the surface of the intermediate transcribing member 110. Particularly, when the intermediate transcribing member 110 is an endless belt supported on a plurality of supporting rollers 120, 121, 122 as in the embodiment, by arranging the sensor 118 to be opposed to the endless belt moving on the supporting rollers, the endless belt is not flapped, detection can be carried out in a state in which a distance between the sensor and the toner image is stabilized.

Further, among the supporting rollers for supporting the endless belt 110, the supporting roller on a side of the primary transcribing position brought into contact with the photosensitive belt 109 may be configured by a large diameter roller. Thereby, nip between the photosensitive belt 109 and the intermediate transcribing member 110 at the primary transcribing position is enlarged and the toner image can sufficiently be transcribed from the photosensitive belt 109 onto the intermediate transcribing member 110. Further, the sensor 118 is opposed to the endless belt moving on the large diameter roller 120 and therefore, a face of the endless belt becomes approximately a plane and the measurement error can further be reduced.

Further, by enlarging the nip between the photosensitive belt 109 and the intermediate transcribing member 110, the intermediate transcribing member 110 can be made to be driven to rotate. The intermediate transcribing member 110 is moved at a speed equal to that of the driven photosensitive belt 109 and therefore, shift of an image at the primary transcribing position or jitter by a drive source can be reduced and the toner adhering amount can further stably be detected.

Further, a spring 123 may be connected to a single piece of the supporting rollers (for example, supporting roller 122) as necessary as a tension roller for absorbing slack of the belt by urging an inner side of the endless belt.

A potential sensor or an optical sensor is used for the toner adhering amount sensor 118. In the case of the potential sensor, a surface potential of the intermediate transcribing member 110 is previously detected, and by detecting a variation in the potential when the toner is adhered thereto, a darkness of the image is made to be controlled. In the case of the optical sensor, the darkness of the image is controlled by detecting reflecting light from a light emitting element by a light receiving element. In the case of the optical sensor, the toner adhering image can be detected highly accurately by calibrating the sensor when the toner does not adhere onto the intermediate transcribing member 110 and detecting a predetermined image patch 136 (refer to FIG. 1) in starting the image forming apparatus.

There are following methods as methods of controlling a darkness of an image and the darkness of the image may be controlled by one method thereamong, or the darkness of the image may be controlled by combining a plurality of the methods. According to the embodiment, control method 1 is applied from a view point that respective colors are easy to control and the toner adhering amount can easily be changed.

(Control Method 1)

Figure 1:
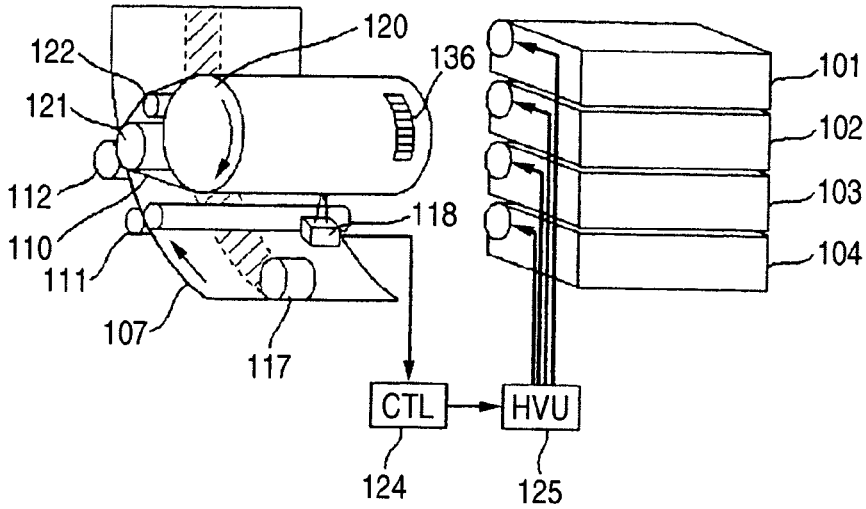
FIG. 1 is an outline configuration view showing an embodiment of the invention.

A toner adhering amount is stabilized by outputting a detecting signal from the toner adhering amount sensor 118 to a control circuit 124 of a printer engine as shown by FIG. 1, carrying out operation in accordance with the detecting signal by the control circuit 124, thereafter, providing a control signal to a high voltage power source 125 and controlling developing biases of the respective developing unit 101, 102, 103, 104.

(Control Method 2)

A toner adhering amount is stabilized by changing an output of laser irradiated from the optical unit 105 in accordance with the detecting signal of the toner adhering amount sensor 118 and changing a potential of an exposed portion on the photosensitive belt 109.

(Control Method 3)

A toner adhering amount is stabilized by changing an output of the charger 108 in accordance with the detecting signal of the toner adhering amount sensor 118 and changing a potential (electrifying potential) of an unexposed portion on the photosensitive belt 109.

(Control Method 4)

A toner adhering amount is stabilized by changing a transcribing voltage at the primary transcribing position in accordance with the detecting signal of the toner adhering amount sensor 118 and changing a transcribing efficiency.

Next, an explanation will be given with regard to an arrangement of the toner adhering amount sensor in reference to FIG. 1. As described above, the sheet 107 is picked up by the sheet feeding roller 117 and is transported in an arrow direction. When a single piece of the sheet feeding roller 117 is provided at a center portion in a width direction (direction perpendicular to a transporting direction) of the sheet 107, paper powder produced by being abraded with the sheet feeding roller 117 is liable to remain at the center portion in the width direction of the fed sheet 107 (hatching region of FIG. 1).

There is a case in which paper powder mounted onto the center portion of the sheet 107 adheres to a center portion of the intermediate transcribing member 110 at the secondary transcribing position, and when the sensor 118 is arranged to be opposed to the center portion of the intermediate transcribing member 110, the toner adhering amount cannot be detected accurately by being interfered by the paper powder.

Hence, with regard to the arrangement of the sensor 118, the sensor 118 is provided in correspondence with a position on an inner side of a width of the intermediate transcribing member 110 and on an outer side of the region at which the sheet feeding roller 117 is brought into contact with the sheet 107 (hatching region of FIG. 1) in a direction perpendicular to a transporting direction of the sheet.

Further, although according to the embodiment, a single piece of the sheet feeding roller is exemplified for convenience of explanation, the invention is not limited thereto but there may be constructed a constitution for providing a plurality of pieces of sheet feeding rollers in the direction perpendicular to the transporting direction of the sheet, and in this case, by arranging the sensor in correspondence with the width between the sheet feeding rollers contiguous to each other, an effect equivalent to that of the case of the single piece of sheet feeding roller is achieved.

As described above, the sensor 118 is provided on the outer side of the region at which the sheet feeding roller 117 is brought into contact with the sheet 107 in the direction perpendicular to the transporting direction of the sheet and therefore, paper powder adhered onto the intermediate transcribing member 110 can be avoided and the toner adhering amount can accurately be detected.

Next, other embodiment of the invention will be explained in reference to FIG. 3. A point thereof which differs from the above-described constitution resides in including cleaning device 126 for cleaning the detecting face of the toner adhering amount sensor 118.

The cleaning device 126 is configured by a lever 128 pivotably supported by a shaft 127 as a fulcrum, and a cleaning blade 129 provided at one end of the lever 128 to be able to be brought into contact with the detecting face of the sensor 118. Other end of the lever 128 is provided to be able to be brought into contact with the sheet feeding cassette 106 to function as device for transmitting movement between the sheet feeding cassette 106 and the cleaning blade 129.

Figure 3:
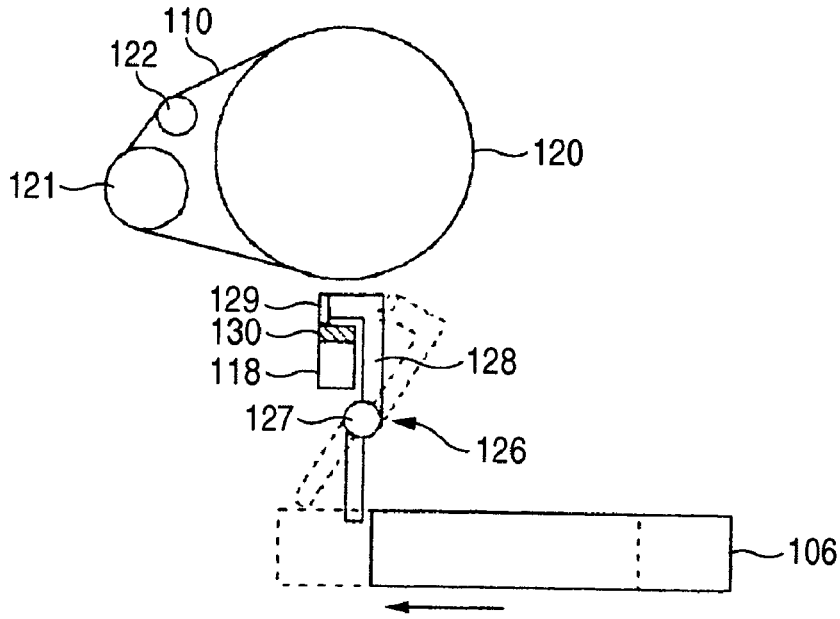
FIG. 3 is an outline configuration view showing a relationship between a sheet feeding cassette and cleaning means.

That is, when the sheet feeding cassette 106 is pushed to advance in an arrow direction from a state designated by a solid line of FIG. 3, the lever 128 brought into an erected state is pivoted to a position designated by a dashed line. At this occasion, the cleaning blade 129 is moved to a position designated by a broken line along with the lever 128 while being brought into contact with the detecting face 130 of the sensor 118. Further, contrary to the above-described, also in operation of drawing out the sheet feeding cassette 106 disposed at the position designated by the dashed line in a direction opposed to the arrow, cleaning of the detecting face 130 by the cleaning blade 129 is carried out.

In this way, according to the embodiment, the detecting face can periodically be cleaned in cooperation with operation of charging the sheet feeding cassette 106 without providing a drive motor for moving the cleaning blade 129.

Further, although in the above-described embodiment, an explanation has been given of the constitution of cleaning the detecting face in cooperation with operation of charging the sheet feeding cassette 106, the embodiment is not limited to the sheet feeding cassette, the detecting face may be cleaned in cooperation with movement of a movable member provided to a main body of the image forming apparatus attachably thereto or detachably therefrom or openably and closably, and there may be constructed a constitution in which the detecting face is cleaned by interposing a lever between a door and the sensor such that the detecting face is cleaned in cooperation with operation of opening and closing the door provided at the main body of the image forming apparatus. Further, the lever may be driven by using the drive motor.

Although a resin film (polyester film or the like) or rubber is used for the cleaning blade 129, an elastic member of sponge or the like may be used therefor. Further, a cover having a light transmitting property may be provided at the detecting face such that the detecting face of the sensor is not damaged by the cleaning blade.

Figure 4:
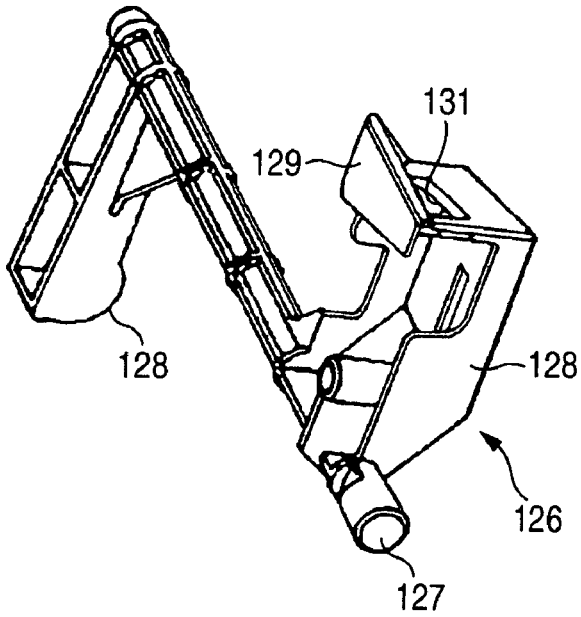
FIG. 4 is a total perspective view of the cleaning means.

In a state in which the lever 128 is erected as shown by the solid line of FIG. 3, an interval between the detecting face 130 of the sensor 118 and the intermediate transcribing member 110 is shut by the lever 128, and when the sheet feeding cassette 106 is not mounted, the toner adhering amount on the intermediate transcribing member 110 cannot be detected. Therefore, when it is necessary to detect the toner adhering amount even in the state of detaching the sheet feeding cassette 106, the surface of the intermediate transcribing member 110 may be made to be able to detect by a through hole 131 even in a state of closing the lever 128 by providing the through hole 131 at the lever 128 as shown by FIG. 4.

Further, erroneous detection is brought about during a time period in which the cleaning blade 129 is passing on the detecting face 130 of the sensor 118 in cooperation with the sheet feeding cassette and therefore, it is preferable that a toner adhering amount is not detected when the sheet feeding cassette 106 is not charged and the toner adhering amount is detected after charging the sheet feeding cassette 106.

Figure 5:
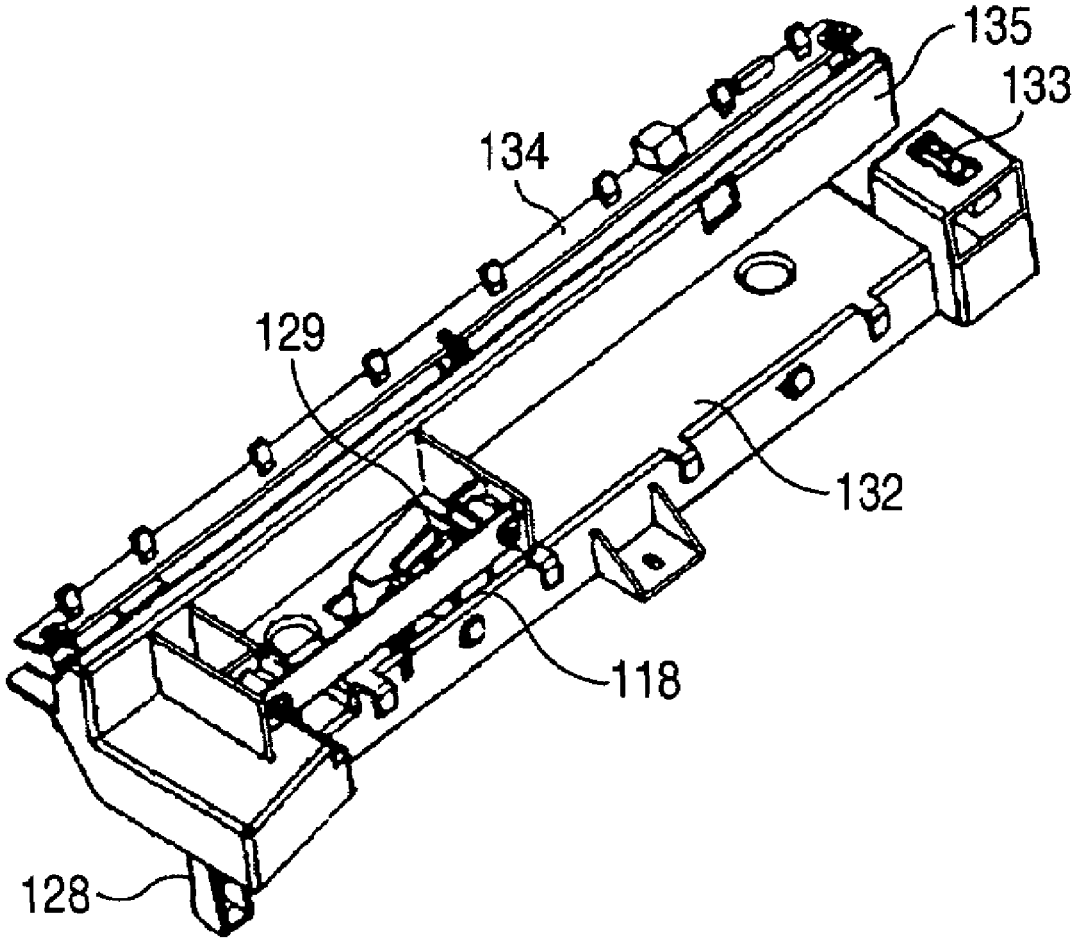
FIG. 5 is a total perspective view of a sensor unit.

FIG. 5 shows a sensor unit in which the toner adhering amount sensor is configured integrally with other member. The unit is realized to be downsized by mounting an encoder 133 and an erase lamp 134 to a base 132 along with the sensor 118, the lever 128 and the cleaning blade 129. Further, a light emitting frequency of the erase lamp 134, a light receiving frequency of the encoder 133 and a light receiving frequency of the sensor 128 are liable to interfere with each other and therefore, a wall face 135 may be provided at the base 132 along a longitudinal direction of the erase lamp 134.

What is claimed is:

1. An image forming apparatus comprising:

detecting means for detecting a toner image held on an image carrier; and transport means for transporting a sheet, wherein the detecting means is disposed opposite the image carrier and offset from the transport means in a width direction of the image carrier, and wherein the detector is arranged on an outer side of a region defined by a point of contact between the transport means and the sheet in the width direction of the image carrier.

2. The image forming apparatus according to claim 1, wherein the image carrier comprises an intermediate transfer member.

3. The image forming apparatus according to claim 1, wherein the image carrier comprises an endless belt supported on a plurality of supporting rollers, and the detecting means is disposed opposite to the endless belt on the supporting rollers.

4. The image forming apparatus according to claim 3, wherein the detecting means is disposed opposite to the endless belt on the supporting roller having a largest diameter in the plurality of supporting rollers.

5. The image forming apparatus according to claim 1, wherein the detecting means comprises a toner adhering amount sensor.

6. The image forming apparatus according to claim 1, further comprising:

cleaning means for cleaning a detecting face of the detecting means, wherein the detecting means is provided with transmission means between the cleaning means and a movable member such that the detecting face is cleaned in cooperation with the movable member provided to a main body of the image forming apparatus.

7. The image forming apparatus according to claim 6, wherein the movable member is attachable to the main body of the image forming apparatus and detachable from the main body of the image forming apparatus.

8. The image forming apparatus according to claim 6, wherein the movable member is capable of opening and closing with respect to the main body of the image forming apparatus.

9. The image forming apparatus according to claim 6, wherein the movable member comprises a sheet feeding cassette.

10. The image forming apparatus according to claim 1, wherein said detecting means directly detects the toner image held on the image carrier.

11. An image forming apparatus, comprising:

an image transfer device;

a photosensitive belt;

a sheet feed roller disposed in a same orientation as the image transfer device; and a sensor disposed opposite the image transfer device and offset from the sheet feed roller in a width direction of the image transfer device, wherein the sensor is arranged on an outer side of a region defined by a point of contact between the sheet feed roller and a sheet in the width direction of the image transfer device, and wherein the sensor is positioned at a lower side of the image transfer device.

12. The image forming apparatus according to claim 11, wherein:

a point of contact between the image transfer device and the photosensitive belt comprises a primary transfer position;

a point of contact between the image transfer device and a transfer roller comprises a secondary transfer position; and the sensor is disposed between the primary transfer position and the secondary transfer position.

13. The image forming apparatus according to claim 11, wherein the sensor is disposed perpendicular to a surface of the image transfer device.

14. The image forming apparatus according to claim 11, wherein:

the image transfer device comprises an endless belt supported on a plurality of supporting rollers, and the sensor is disposed opposite to the endless belt on the supporting rollers.

15. The image forming apparatus according to claim 14, wherein the sensor is disposed opposite to the endless belt on the supporting roller having a largest diameter in the plurality of supporting rollers.

16. The image forming apparatus according to claim 11, wherein the sensor comprises a toner adhering amount sensor.

17. The image forming apparatus according to claim 11, wherein the sensor comprises a cleaning device that cleans a detection surface of the sensor in cooperation with a movable member, wherein the movable member is attachable to and detachable from a main body of the image forming apparatus or capable of opening or closing with respect to a main body of the image forming apparatus, wherein the cleaning device cleans the detection surface of the sensor in conjunction with the movable member, and wherein a transmission device is disposed between the movable member and the cleaning device.

18. The image forming apparatus according to claim 17, wherein the movable member comprises a sheet feeding cassette.

19. An image forming apparatus, comprising:

an image transfer device;

a photosensitive belt;

a sheet feed roller disposed in a same orientation as the image transfer device; and a sensor, for sensing a toner image held on an image carrier, disposed opposite the image transfer device and offset from the sheet feed roller in a width direction of the image transfer device, wherein the sensor is arranged on an outer side of a region defined by a point of contact between the sheet feed roller and a sheet in the width direction of the image transfer device.

20. The image forming apparatus according to claim 19, wherein the detecting means comprises a toner adhering amount sensor.

* * * * *